US005543283A

United States Patent [19]

Whitson et al.

[11] Patent Number: 5,543,283

[45] Date of Patent: Aug. 6, 1996

[54] ATTACHMENT OF GELATIN-GRAFTED PLYMER PARTICLES TO PRE-PRECIPITATED SILVER HALIDE GRAINS

[75] Inventors: Mark A. Whitson; John D. Lewis, both of Webster; Tienteh Chen, Penfield; Thomas J. Dannhauser, Pittsford; Pranab Bagchi, Webster, all of N.Y.

[73] Assignee: Eastman Kodak Company, Rochester, N.Y.

[21] Appl. No.: 346,727

[22] Filed: Nov. 30, 1994

Related U.S. Application Data

[62] Division of Ser. No. 122,191, Sep. 14, 1993, Pat. No. 5,399,480.

[51] Int. Cl.[6] ..... G03C 1/005

[52] U.S. Cl. ..... 430/569; 430/627; 430/628; 430/642

[58] Field of Search ..... 430/569, 642, 430/503, 531, 536, 537, 539, 627, 628, 950, 567, 138

[56] References Cited

U.S. PATENT DOCUMENTS

| | | | |
|---|---|---|---|
| 2,398,004 | 4/1946 | Houck et al. | 530/355 |
| 2,487,858 | 11/1949 | Dean et al. | 430/359 |
| 2,614,929 | 10/1952 | Yutzy et al. | 430/569 |
| 2,618,553 | 11/1952 | Baines et al. | 430/549 |
| 2,698,794 | 1/1955 | Godowsky | 430/549 |
| 2,698,796 | 1/1955 | Chechak et al. | 430/545 |
| 2,763,552 | 9/1956 | Van Campen et al. | 430/545 |
| 2,831,767 | 4/1958 | Dann et al. | 430/628 |
| 2,843,488 | 7/1958 | Godowsky | 430/627 |
| 2,956,884 | 10/1960 | Caldwell | 430/627 |
| 2,965,484 | 12/1960 | Tulagin et al. | 430/365 |
| 3,186,846 | 6/1965 | Carlisle | 430/642 |
| 3,291,611 | 12/1966 | Krajewski | 430/628 |
| 3,436,220 | 4/1969 | Dersch et al. | 430/642 |
| 3,501,301 | 3/1970 | Nadeau et al. | 430/535 |
| 3,507,661 | 4/1970 | Ofstead | 430/628 |
| 3,551,151 | 12/1970 | Malan | 430/503 |
| 3,576,628 | 4/1971 | Beavers | 430/244 |

(List continued on next page.)

OTHER PUBLICATIONS

P. Bagchi, "Theory of Stabilization of Spherical Colloidal Particles by Nonionic Polymers", J. Colloid and Interface Science 47,100 (1974).

D. R. Bassett and K. L. Hoy, "The Expansion Characteristics of Carboxylic Emulsion Polymers—I. particle Expansion Determination By Sedimentation", in Polymer Colloids—II, R. M. Fitch, Ed., Plenum, New York, 1978, p. 1.

P. Bagchi and S. M. Birnbaum, "Effect of pH on the Adsorption of Immunoglobulin–G on Anionic Poly(vinyltoluene) Model Latex Particles", J. Colloid and Interface Science 83, 460 (1981).

P. Bagchi, B. V. Gray, and S. M. Bisnbaum, "Preparation of Model Polyvinyltoluene Latexes and Characterization of Their Surface Charge by Titration and Electrophoresis", J. Colloid and Interface Science 69, 502 (1979).

James, T. H., "The Theory of the Photographic Process", 4th Edition, New York (1977).

Curme, H. G. et al, J. Phys. Chem. 63, 3009 (1964).

Cohen, J. I. et al, Adv. Chem. Ser. 45, 198 (1973).

Holland, A. et al, J. Appl. Photogr. Eng. 8, 165(1982).

Anonymous, "Photographic Silver Halide Emulsions, Preparations, Addenda, Processing, and Systems", Research Disclosure 308, p. 993, Dec. 1989.

*Primary Examiner*—Janet C. Baxter
*Attorney, Agent, or Firm*—Andrew J. Anderson

[57] ABSTRACT

The invention describes silver halide packet emulsion grains or crystals that are conventionally precipitated using gelatin of a given isoelectric pH, surrounded by a layer of gelatin-grafted-polymer particles wherein the grafted gelatin has a different isoelectric pH and the said gelatin-grafted-polymer particles are optionally chemically bonded to the gelatin surrounding the silver halide microcrystals. Such packet emulsions can form the basis for a mixed-packet color photographic system.

12 Claims, 9 Drawing Sheets

U.S. PATENT DOCUMENTS

| | | | |
|---|---|---|---|
| 3,615,407 | 10/1971 | Hodes | 430/136 |
| 3,619,195 | 11/1971 | Van Campen | 430/505 |
| 3,697,279 | 10/1972 | Rogers et al. | 430/228 |
| 3,706,564 | 12/1972 | Hollister et al. | 430/627 |
| 3,813,251 | 5/1974 | Hollister et al. | 430/627 |
| 3,816,129 | 6/1974 | Fitzgerald | 430/569 |
| 3,832,183 | 8/1974 | Rogers et al. | 430/559 |
| 4,021,244 | 5/1977 | Nagatomo et al. | 430/539 |
| 4,080,211 | 3/1978 | Van Paesschen | 430/548 |
| 4,142,894 | 3/1979 | Hori et al. | 430/351 |
| 4,199,363 | 4/1980 | Chen | 430/512 |
| 4,201,586 | 5/1980 | Hori et al. | 430/621 |
| 4,266,010 | 5/1981 | Nagatomo et al. | 430/355 |
| 4,268,627 | 5/1981 | Sera et al. | 430/621 |
| 4,278,749 | 7/1981 | Wright | 430/213 |
| 4,301,240 | 11/1981 | Brück et al. | 430/537 |
| 4,334,012 | 6/1982 | Mignot | 430/567 |
| 4,338,394 | 7/1982 | Himmelmann et al. | 430/621 |
| 4,396,709 | 8/1983 | Kameoka et al. | 430/539 |
| 4,407,940 | 10/1983 | Nakamura et al. | 430/546 |
| 4,447,525 | 5/1984 | Vallarino et al. | 430/539 |
| 4,464,462 | 8/1984 | Sugimoto et al. | 430/512 |
| 4,497,893 | 2/1985 | Deguchi et al. | 430/359 |
| 4,510,228 | 4/1985 | Tsubai et al. | 430/204 |
| 4,524,131 | 6/1985 | Himmelmann et al. | 430/523 |
| 4,569,898 | 2/1986 | Cottrell | 430/207 |
| 4,581,328 | 4/1986 | Matsuyama | 430/567 |
| 4,684,605 | 8/1987 | Remley | 430/537 |
| 4,714,671 | 12/1987 | Helling et al. | 430/545 |
| 4,722,885 | 2/1988 | Yokoyama et al. | 430/531 |
| 4,735,887 | 4/1988 | Foss et al. | 430/264 |
| 4,751,176 | 6/1988 | Pham | 430/619 |
| 4,816,290 | 3/1989 | Heki et al. | 430/567 |
| 4,830,947 | 5/1989 | Oka | 430/138 |
| 4,830,948 | 5/1989 | Ishikawa et al. | 430/372 |
| 4,855,219 | 8/1989 | Bagchi et al. | 430/496 |
| 4,865,940 | 9/1989 | Schranz | 430/138 |
| 4,877,720 | 10/1989 | Sato et al. | 430/512 |
| 4,879,208 | 11/1989 | Urabe | 430/569 |
| 4,895,791 | 1/1990 | Mukunoki | 430/523 |
| 4,914,007 | 4/1990 | Fujita et al. | 430/372 |
| 4,920,004 | 4/1990 | Bagchi | 173/85 |
| 4,942,120 | 6/1990 | King et al. | 430/567 |
| 4,973,547 | 11/1990 | Schmidt | 430/567 |
| 5,026,632 | 6/1991 | Bagchi et al. | 430/545 |
| 5,055,379 | 8/1991 | Bachi et al. | 406/166 |
| 5,066,572 | 11/1991 | O'Connor et al. | 430/503 |
| 5,091,296 | 2/1992 | Bagchi et al. | 430/546 |
| 5,178,997 | 1/1993 | Maskasky | 430/569 |
| 5,187,259 | 2/1993 | Sterman et al. | 430/539 |
| 5,248,558 | 9/1993 | Bagchi et al. | 430/642 |
| 5,318,889 | 6/1994 | Bagchi et al. | 430/642 |
| 5,378,598 | 1/1995 | Bagchi et al. | 430/569 |

1 μm

1 μm

1 μm

1 μm

1 μm

ATTACHMENT OF GELATIN-GRAFTED PLYMER PARTICLES TO PRE-PRECIPITATED SILVER HALIDE GRAINS

This is a Divisional of application U.S. Ser. No. 122,191, filed 14 Sep. 1993, now U.S. Pat No. 5,399,480.

FIELD OF THE INVENTION

This invention relates to a photosensitive silver halide emulsion composition, a method of preparing said composition and to a mixed packet photosensitive photographic element.

RELATED ART (RA-1) T. H. James, "The Theory of the Photographic Process," 4th Edition, New York (1977).

(RA-2) K. R. Hollister and E. J. Perry, U.S. Pat. No. 3,813,251 (1974), describes the preparation of AgX grains using thioether group containing acrylate copolymers; M. J. Fitzgerald, "Synthetic Silver Halide Emulsion Binders," U.S. Pat. No. 3,816,129 (1974).

(RA-3) P. Bagchi, "Gelatin-Grafted-Polymer Particles," U.S. Pat. No. 4,920,004 (1990).

(RA-4) P. Bagchi, M. D. Sterman, and H. M. Low, "Photographic Element Having Polymer Particles Covalently Bonded to Gelatin," U.S. Pat. No. 4,855,219 (1989); K. M. O'Conner, R. P. Szajewski, and P. Bagchi, "Control of Pressure-Fog with Gelatin-Grafted and Case-Hardened Gelatin-grafted-soft Polymer Particles," U.S. Pat. No. 5,066,572 (1991); P. Bagchi, R. F. Reithal, T. J. Chen, and S. Evans, "Photoresist Dichromate Composition Containing Gelatin Coated Particles," U.S. Pat. No. 5,055,379 (1991).

(RA-5) P. Bagchi, "Theory of Stabilization of Spherical Colloidal Particles by Nonionic Polymers," J. Colloid and Interface Science 47, 100 (1974).

(RA-6) P. Bagchi and W. L. Gardner, "Use of Gelatin-Grafted and Case-Hardened Gelatin-grafted-polymer Particles for Relief from Pressure Sensitivity of Photographic Products," U.S. Pat. No. 5,026,632 (1991).

(RA-7) W. Schmidt, "Photographic Material," U.S. Pat. No. 4,973,547 (1990); S. A. King and J. E. Maskasky, "Modified Peptizer Twinned Grain Silver Halide Emulsions and Process for Their Preparation," U.S. Pat. No. 4,942,120 (1990).

(RA-8) T. J. Chen, Describes loading of photographically useful compounds into latex particles for delivery in photographic coating, U.S. Pat. No. 4,199,363 (1980).

(RA-9) P. Bagchi, S. J. Sargeant, J. T. Beck, and B. Thomas, "Polymer Co-Precipitated Coupler Dispersion," U.S. Pat. No. 5,091,296 (1992).

(RA-10) H. Bains, E. P. Davey, and E. T. Teal, U.S. Pat. No. 2,618,553 (1946) describes a mixed-packet color photographic process.

(RA-11) P. Bagchi, B. V. Gray, and S. M. Bisnbaum, "Preparation of Model Polyvinyltoluene Latexes and Characterization of Their Surface Charge by Titration and Electrophoresis," J. Colloid and Interface Science 69, 502 (1979).

(RA-12) H. G. Curme and C. C. Natale, J. Phys. Chem. 63, 3009 (1964).

(RA-13) K. Sato, S. Ohno, and S. Yamada, "Silver Halide Photographic Material," U.S. Pat. No. 4,877,720 (1989).

(RA-14) N. Sujimoto, T. Kojima, and Y. Mukunoki, "Silver Halide Photographic Light-Sensitive Material," U.S. Pat. No. 4,464,462 (1984).

(RA-15) A. G. Van Paesschen, "Polymerization of Monomeric Couplers," U.S. Pat. No. 4,080,211 (1978).

(RA-16) J. J. Chechak and S. S. Firke, "Resin Salt of Couplers in Mixed-Packet Photographic Emulsions," U.S. Pat. No. 2,698,796 (1955).

(RA-17) L. Godowsky and L. M. Minsk, "Mixed-Packet Photographic Emulsions Using Resin Couplers," U.S. Pat. No. 2,698,797 (1955).

(RA-18) J. H. Van Campen and J. W. Gates, "Modifiers for Photographic Packet Emulsions," U.S. Pat. No. 2,763,552 (1956).

(RA-19) V. Tulagin and R. D. Jackson, "Mixed-Packet Photographic Emulsions," U.S. Pat. No. 2,965,484 (1960).

(RA-20) L. Godowsky, "Mixed-Packet Photographic Emulsions," U.S. Pat. No. 2,698,794 (1955).

(RA-21) K. W. Schranz, "Photographic Recording Material," U.S. Pat. No. 4,865,940 (1989).

(RA-22) A. G. E. Mignot, "Silver Halide Precipitation Process with Deletion of Materials, U.S. Pat. No. 4,334,012 (1982).

(RA-23) S. Urabe, "Process for Preparing Silver Halide Grains," U.S. Pat. No. 4,879,208 (1989).

(RA-24) J. I. Cohen, W. L. Gardner, and A. H. Herz, Adv. Chem. Ser. 45, 198 (1973).

(RA-25) A. Holland and A. Fieinerman, J. Appl. Photogr. Eng. 8, 165 (1982).

(RA-26) Anonymous, "Photographic Silver Halide Emulsions, Preparations, Addenda, Processing, and Systems," Research Disclosure 308, p. 993, December 1989.

(RA-27) D. R. Bassett and K. L. Hoy, "The Expansion Characteristics of Carboxylic Emulsion Polymers-I. Particle Expansion Determination by Sedimentation," in Polymer Colloids-II, R. M. Fitch, Ed., Plenum, New York, 1978, p. 1.

(RA-28) P. Bagchi and S. M. Birnbaum, "Effect of pH on the Adsorption of Immunoglobulin-G on Anionic Poly(vinyltoluene) Model Latex Particles," J. Colloid and Interface Sci. 83, 460 (1981).

(RA-29) H. C. Yutzy and P. J. Russell, "Methods of Preparing Photographic Emulsions," U.S. Pat. No. 2,614,929 (1952).

(RA-30) J. D. Lewis, M. A. Whitson, T. J. Dannhauser, T. Chen, and P. Bagchi, "Gelatin-Grafted-Polymer Particles as Peptizer for Silver Halide Emulsions," copended U.S. application Ser. No. 08/1,361 filed Jan. 7, 1993.

BACKGROUND OF THE INVENTION

Photographic emulsions typically comprise silver halide particles dispersed in an aqueous medium. Traditionally, various types of gelatin have been used as a peptizer for the precipitation of photographic silver halide emulsions. This results in a layer of adsorbed gelatin surrounding each silver halide grain. The hydrated thickness of the gelatin layer may vary anywhere from 10 to 60 nm. Silver halide particles comprising silver halide grains each surrounded by a layer of peptizing gelatin are referred to herein as "silver halide-gelatin particles".

Photographically useful compounds, such as filter dyes, development inhibitor releasing couplers, development inhibitor anchimeric release couplers, dye-forming couplers, nucleators, ultraviolet radiation absorbing materials, development accelerators (sometimes referred to as boosters in the art), developers, sensitizing dyes, and the like can be incorporated into photographic emulsions. Typically such photographically useful compounds are added to an emulsion in the form of oil-in-water dispersions resulting in a photographic composition comprising silver halide particles and dispersed droplets comprising the photographically useful compound.

Conventional color photographic elements comprise a plurality of layers coated on a support. In such a photographic element there is at least one color sensitive layer for each of the colors red, green and blue. Mixed-layer color photographic systems have been proposed. A mixed-layer color photographic system is one in which a single photographic layer is made up of silver halide grains with different spectral sensitizations. The manufacturing benefit of such a system is clear: reduction of the number of layers in a color photographic system. The ability to collapse (reduce the number of) differently sensitized layers (different by color or by speed) can lead to cost savings.

There are two kinds of mixed-layer color photographic systems. The system in which differently sensitized silver halide emulsion grains are mixed together in a single layer without incorporation of the corresponding image-forming dye components (often referred to in the art as couplers) is generally called a mixed-grain coating.

The second type of mixed-layer system also contains differently sensitized silver halide emulsion particles but in addition contains different image-forming dye components associated with the silver halide sensitized for each region of the spectrum. The particles that are mixed may or may not be individual silver halide grains. In many coatings of this kind, silver halide grains of a certain sensitivity and the appropriate image-forming dye or dye component are both dispersed in a colloidal vehicle; this vehicle with its contents is then dispersed as globules in a continuous phase or "matrix" consisting of a second colloid vehicle not compatible with the first. A mixture of two or more such dispersions containing particles of different spectral sensitivity is commonly called a mixed-packet coating. However, there are other materials in which image-forming dyes or dye components are intimately associated with the color-sensitized silver halide grains themselves, as by adsorption or complex formation, and the grains are mixed in a single emulsion vehicle. Such materials are also considered mixed-packet materials.

The processing of mixed-packet materials is usually simpler than that of mixed-grain materials. This is the result of associating the proper image-forming dye or dye component with the silver halide sensitized for each region of the spectrum. A single chemical step can suffice, therefore, to form all the dye images, each under the control of the proper set of silver or silver halide grains. On the other hand, mixed-grain materials usually require not only the original exposure to the subject, but also two or more reversal exposures to light of different colors, each followed by a reversal development in a different color developer solution containing a soluble coupler to introduce the three dye components one after another and to form the three dye images, each under the control of the proper set of differently sensitized grains.

Because of the potential commercial value of an acceptable quality mixed-packet system, extensive work has been done as indicated in the prior art references U.S. Pat. Nos. 2,698,796 to Chechak et al., 2,698,797 to Godowsky et al., 2,763,552 to Van Campen et al., 2,965,484 to Tulagin et al., 2,698,794 to Godowsky, and 4,865,940 to Schranz (RA-16 through RA-21). However, none of the prior art mixed-packet systems has achieved commercial success.

Our copending application Ser. No. 08/1,361 filed Jan. 7, 1993 (RA-30), the disclosure of which is incorporated herein by reference, describes the precipitation of Ag-halide emulsions in the presence of gelatin-grafted-polymer particles comprising a photographically useful compound. By the method disclosed in this copending application one obtains polymer particles directly attached to the Ag-halide microcrystals. As elucidated in RA-30, there are many advantages associated with having such polymer particles attached to silver halide grains in emulsion systems, including the preparation of mixed packet photographic systems. However, the method described in this patent application requires modification of known emulsion preparation processes to optimize the process for use with the gelatin-grafted-polymer particles.

PROBLEM TO BE SOLVED BY THE INVENTION

There is a need to improve delivery of photographically useful compounds to silver halide particles in a photographic emulsion without having to modify and/or optimize conventional emulsion forming processes. In particular, there is a need to improve delivery of photographically useful compounds to specifically sensitized silver halide particles specific to the spectral sensitivity of the silver halide particles in order to form mixed-packet color photographic systems.

SUMMARY OF THE INVENTION

We have discovered that the advantages of associating gelatin-grafted-polymer particles with silver halide particles as set forth in our above-mentioned copending application RA-30 can be achieved with preformed, pre-precipitated, conventional silver halide emulsions. This permits the use of silver halide emulsions prepared by conventional manufacturing techniques well known and/or optimized for a particular photographic element.

One aspect of this invention comprises a photosensitive silver halide emulsion composition comprising in an aqueous medium:

(a) silver halide-gelatin particles comprising silver halide grains, each surrounded by a layer of adsorbed gelatin wherein the gelatin has an isoelectric pH of $P_1$; and (b) gelatin-grafted-polymer particles wherein the gelatin has an isoelectric pH of $P_2$ which is different than $P_1$;

wherein the gelatin-grafted-polymer particles are attached to the layer of gelatin surrounding the silver halide grains.

The attachment of the gelatin-grafted-polymer particles to the silver halide particles may be physical or chemical.

Another aspect of this invention comprises a method of preparing a photographic silver halide emulsion composition comprising:

(i) mixing in an aqueous medium (a) silver halide-gelatin particles comprising silver halide grains, each surrounded by a layer of adsorbed gelatin, in which the gelatin has an isoelectric pH of $P_1$; and (b) gelatin-grafted-polymer particles in which the gelatin has an isoelectric pH of $P_2$ which is different than $P_1$; and (ii) adjusting the pH of the aqueous medium to a value that is between $P_1$ and $P_2$, whereby gelatin-grafted-polymer particles are attached to the silver halide gelatin particles.

The method can further comprise the step of cross linking the gelatin-grafted-polymer latex particles to the gelatin surrounding the silver halide grains using a gelatin hardener.

Yet another aspect of this invention comprises a mixed-packet photosensitive photographic element comprising at least one of the following packet emulsion elements:

silver halide particles sensitive to red light and comprising silver halide grains each surrounded with a layer gelatin wherein the gelatin has an isoelectric pH of $P_{1a}$ and attached thereto gelatin-grafted-cyan dye-forming coupler particles wherein the gelatin has an isoelectric pH of $P_{2a}$ which is different than $P_{1a}$, silver halide particles sensitive to green light and comprising silver halide grains each surrounded with a layer gelatin wherein the gelatin has an isoelectric pH of $P_{1b}$ and attached thereto gelatin-grafted-magenta dye-forming coupler particles wherein the gelatin has an isoelectric pH of $P_{2b}$ which is different than $P_{1b}$, silver halide particles sensitive to blue light and comprising silver halide grains each surrounded with a layer gelatin wherein the gelatin has an isoelectric pH of $P_{1c}$ and attached thereto gelatin-grafted-yellow dye-forming coupler particles wherein the gelatin has an isoelectric pH of $P_{2c}$ which is different than $P_{1c}$.

In each packet element the gelatin of the two types of particles may be chemically bonded with a gelatin cross linking agent.

A further aspect of this invention comprises a photosensitive silver halide emulsion composition comprising in an aqueous medium:

(a) silver halide-gelatin particles comprising silver halide grains, each surrounded by a layer of gelatin wherein the gelatin has an isoelectric pH of $P_1$; and (b) gelatin-grafted-soft polymer particles wherein the gelatin has an isoelectric pH of $P_2$ which is different than $P_1$;

wherein the gelatin-grafted-soft polymer particles are attached to the layer of gelatin surrounding the silver halide grains. Soft polymer particles are particles of a polymer that has a glass transition temperature lower that room temperature (i.e. lower than about 25° C).

The compositions comprising the soft polymer particles tend to be less pressure sensitive than conventional silver halide emulsion compositions.

ADVANTAGEOUS EFFECT OF THE INVENTION

The invention has numerous advantages over prior photographic products and processes for their production. The invention provides gelatin-grafted-polymer particles loaded with photographically useful compounds or gelatin-grafted-polymeric photographically useful compounds attached to the gelatin layer surrounding a conventionally pre-precipitated silver halide grains. These photographically useful compounds are in close association with the silver halide grains and therefore can readily react during photographic processing. The ability to mix different spectrally sensitized silver halide grains that are surrounded by dye forming coupler particles complementary to the spectral sensitization of the silver halide particles allows mixing in one silver halide layer of a photographic element, packets of magenta, cyan and yellow dyes with development only of the coupler that is bound to the gelatin layer surrounding a particular sensitized silver halide grain.

DETAILED DESCRIPTION OF THE INVENTION

This invention provides gelatin-grafted-polymer particles attached to conventionally pre-precipitated silver halide emulsion grains, each with a layer of its own peptization gelatin around the silver halide grain. A silver halide grain together with its layer of peptizing gelatin is referred to herein as a "silver halide-gelatin particle".

Figure 1A:
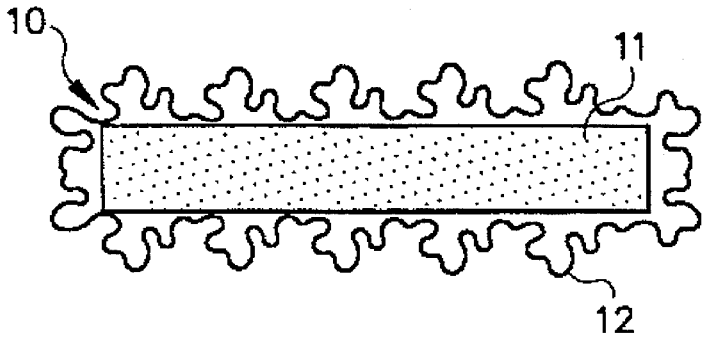
FIG. 1*a* illustrates a silver halide-gelatin particle which comprises a silver halide grain precipitated in an aqueous gelatin medium.

FIG. 1*a* illustrates a conventionally precipitated silver halide particle 10 comprising a silver halide tabular grain 11 and a surrounding gelatin layer 12. It is to be understood that the term "conventionally" merely states that the silver halide grains are prepared in an aqueous medium containing peptizing gelatin that adheres to the grains. Such processes are conventional. It is recognized that improvements of the basic process may be made from time to time. It is contemplated that any silver halide grains produced by precipitation in an aqueous gelatin-containing medium are suitable for use in this invention, even if the details of the precipitation process are developed hereafter.

Various types of methods used in the preparation of photographic silver halide emulsions have been described in detail in prior art references For example, T. H. James, "The Theory of the Photographic Process," 4th Edition, New York (1977).(RA-1); U.S. Pat. No. 4,334,012 to Mignot (RA-22) and U.S. Pat. No. 4,879,208 to S. Urabe (RA-23). The emulsion may be a AgCl, AgBr, AgI, AgCl(Br), AgCl(I), AgClBr(I), or AgBr(I) emulsion. Preferred are silver halide grains comprising silver chloride, silver iodobromide, or silver chlorobromide. The silver halide grains preferably have a single dimension ranging between about 10 nm to about 10,000 nm. The weight of gelatin used for precipitation of silver halide-gelatin particles for use in this invention depends on the crystal morphology or shape of the silver halide grains to be prepared and their sizes. It may range from about 2 grams of gelatin to about 200 grams of gelatin per mole of the silver halide emulsion prepared. The amount is determined by the size of the emulsion grains, such that after the emulsion is formed substantially all the gelatin is bound to the silver halide grain surface, as discussed more fully below. The emulsion particles may be cubic, octahedral, rounded octahedral, polymorphic, tabular or thin tabular emulsion grains. Preferred are silver halide grains having a cubic, octahedral, or tabular crystal structure. Such silver halide grains may be regular untwinned, regular twinned, or irregular twinned with cubic or octahedral faces.

The gelatin starting material may be a regular lime processed or acid processed ossein gelatin or various derivatized gelatins as described in related art T. H. James, "The Theory of the Photographic Process," 4th Edition, New York (1977).(RA-1) and U.S. Pat. No. 5,026,632 to Bagchi et al (RA-6). Gelatins such as phthalated, acetylated, or alkylated gelatins, such as succinated gelatin, are particularly useful in some embodiments of this invention. Variation of the types of gelatin provides variations in the isoelectric pH of the formed particles. This variation in the isoelectric pH provides the basis of particle attachment, as discussed in more detail below. The gelatin adsorbed on the silver halide grains has an isoelectric pH of $P_1$.

Generally, the amount of gelatin surrounding each grain should be about 10 mg per sq meter of the surface of the emulsion grains. This consideration is similar to that provided for the gelatin-grafting-polymer particles, as discussed more fully below.

Figure 1B:
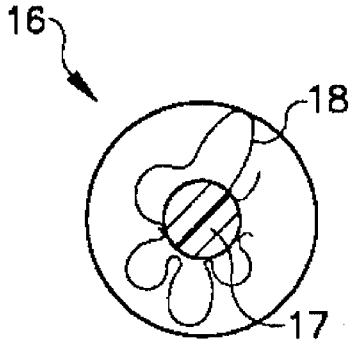
FIG. 1*b* illustrates a gelatin-grafted-polymer particle.

FIG. 1*b* illustrates a gelatin-grafted-polymer particle 16 comprising a polymer core 17 and a surrounding gelatin layer 18.

The preparation of gelatin-grafted-polymer particles has been extensively described earlier, for example, in U.S. Pat. No. 4,920,004 to Bagchi,(RA-3); U.S. Pat. Nos. 4,855,219 to Bagchi et al., 5,066,572 to O'Conner et al and 5,055,379 to Bagchi et al (RA-4); and U.S. Pat. No. 5,026,632 to Bagchi et al.(RA-6), the disclosures of which are incorporated herein by reference. Polymers useful in the preparation of gelatin-grafted-polymer particles are any polymers capable of covalently bonding with gelatin, either directly or with the aid of a grafting agent. Preferred polymers that covalently bond directly with gelatin are homopolymers and copolymers of monomers containing active halogen atoms, isocyanates, epoxides, monomers containing aldehyde groups, and monomers containing chloroethylsulfone groups or vinyl sulfone groups. Preferred polymers that are capable of bonding with gelatin through the use of a cross linking agent include carboxylic acids, amine-containing monomers, and active methylene group-containing monomers.

Generally, the polymer particles are formed by emulsion polymerization, suspension polymerization, or limited coalescence to form a latex. The polymer particles in the latex generally have a diameter of about 10 to about $10^6$ nm. As mentioned above, the gelatin is then monomolecularly bonded to the surface of the polymer particles of the latex by direct chemical reaction or by the use of a chemical grafting agent. A gelatin grafting agent is a chemical compound that will allow bond formation between gelatin and a chemical moiety on the surface of the polymer particle. Typical of such chemical grafting agents suitable for the invention are carbamoylonium compounds, dication ether compounds, and carbodiimide compounds, for example the compounds disclosed in above-mentioned U.S. Pat. No. 5,066,572.

Of particular importance to this invention are the gelatin-grafted-polymer particles that have been prepared such that there is substantially no excess gelatin remaining in solution of the gelatin-grafted-polymer latex system. In other words, the gelatin-grafted-polymer samples that are useful for this invention have substantially all the gelatin molecules bound to the polymer particle surface. Therefore, the amount of gelatin to be used depends upon the specific surface area (S) of the latex particles. The specific surface area of polymer particles depends upon the mean particle diameter of the particle (D). S is given by $$S=6\rho/D$$

(1) where $\rho$ is the density of the polymer particle. The saturation adsorption of gelatin depends upon the pH and ionic strength of the solution. However, as a general rule the saturation adsorption of about 10 mg/sq meter of surface is a reasonable estimate. See J. Phys. Chem. 63, 3009 (1964) by Curme et al. and U.S. Pat. No. 5,091,296 to Bagchi et al. (RA-12 and RA-9). The gelatin-grafted-polymer particles of this invention are those that have been prepared at gelatin coverages that are less than about 10 mg of gelatin per sq meter of the polymer particle surface and preferably below about 8 mg of gelatin per sq meter of the polymer particle surface.

Figure 1C:
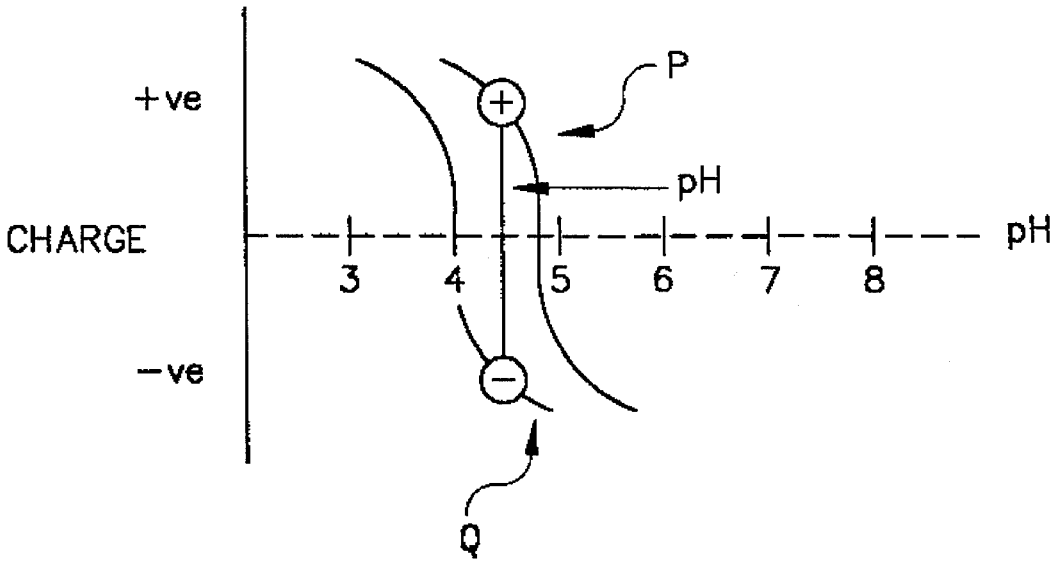
FIG. 1*c* illustrates the pH dependence of charge of standard lime processed ossein gelatin and that of standard lime processed ossein gelatin-grafted-polymer particles.

The gelatin starting material used to prepare the gelatin-grafted-polymer particles may be a regular lime processed or acid processed ossein gelatin or various derivatized gelatins as described in related art T. H. James, "The Theory of the Photographic Process," 4th Edition, New York (1977) (RA-1) and U.S. Pat. No. 5,026,632 to Bagchi et al (RA-6). Gelatins such as phthalated, acetylated, alkylated, or succinated gelatin, may be particularly useful in some embodiments of this invention. Variation of the types of gelatin provides variations in the isoelectric pH of the formed particles. The gelatin in the gelatin-grafted-polymer particles has an isoelectric pH of $P_2$, which is different from $P_1$, the isoelectric pH of the gelatin adsorbed on the pre-precipitated silver halide grains. The difference between $P_1$ and $P_2$ should be at least about one unit of pH value, preferably at least about 1.5 units, and more preferably about 2.0 units. $P_2$ generally differs from the isoelectric pH of the gelatin starting material, as illustrated in FIG. 1*c*. In FIG. 1*c*, the line P represents the pH dependence of charge of standard lime processed ossein gelatin and the line Q represents that of standard lime processed ossein gelatin-grafted-polymer particles.

In general, the gelatin starting material may be the same as the gelatin starting material used for preparing the silver halide-gelatin particles or it may be a different gelatin, providing that the gelatin when attached to the silver halide grains has a different isoelectric pH than when grafted onto the polymer particles. This is due to the reaction of some of the amine group in the gelatin molecule during the grafting reaction.

Figure 1D:
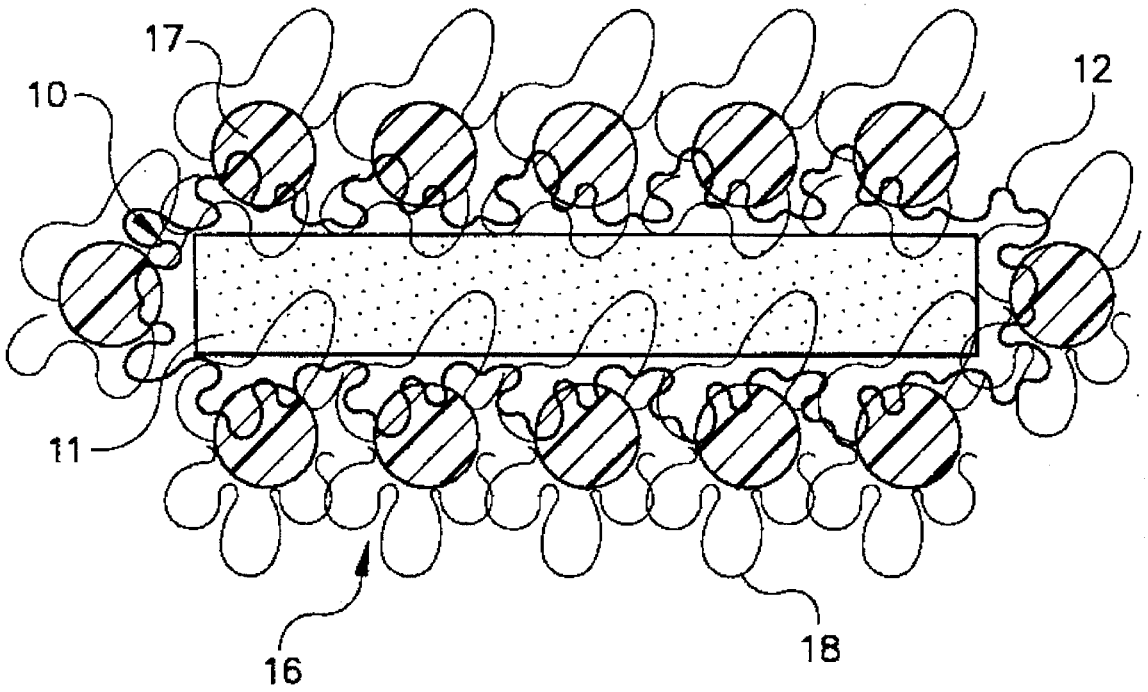
FIG. 1*d* illustrates gelatin-grafted-polymer particles attached to a pre-precipitated silver halide-gelatin emulsion particle.

In accordance with this invention, gelatin-grafted-polymer particles are attached to the gelatin surrounding the pre-precipitated silver halide grains. The resulting composite particle is shown in FIG. 1*d*. In FIG. 1*d*, gelatin-grafted-polymer particles 16, comprising polymer core 17 and gelatin 18, are attached to silver halide particle 10, comprising a silver halide grain 11 and a layer of absorbed gelatin 12.

The gelatin-grafted-polymer particles are attached to the silver halide-gelatin particles by mixing the two types of particles in an aqueous medium and adjusting the pH of the medium by adding base or acid, as appropriate, to a pH value between the isoelectric pH values of the layers of gelatin surrounding the two different types of particles, that is between $P_1$ and $P_2$. Any base or acid can be used to adjust the pH. Preferred acids and bases include, for example, sulfuric acid, nitric acid, sodium hydroxide, etc.

The process of physical attachment of the gelatin-grafted-polymer particles involves the dissimilarity of the net charge at a given pH between the gelatin bonded to the surface of the gelatin-grafted-polymer particles and the gelatin adsorbed on the surface of the silver halide particles, as depicted in FIG. 1*c*. If the pH of the medium is between $P_1$ and $P_2$, the charge on the outer gelatin layers of the two types of particles are opposite and the gelatin-grafted-polymer particles will be attached to the gelatin coated silver halide grains. This opposite charge interaction forms the basis for the physical attachment (prior to chemical bonding) of the gelatin-grafted-polymer particles to the silver halide-gelatin particles.

The gelatin-grafted-polymer particles used in an amount sufficient to surround substantially the surface of the individual silver halide-gelatin particles.

The process described above results in composite particles in which the gelatin layer of the pre-precipitated silver halide particles is physically attached to the gelatin of the gelatin-grafted-polymer particles. The gelatin of the component particles can be further chemically attached by using a gelatin cross linking agent. As there is little, if any, unbound gelatin in solution, the process will cause the gelatin-grafted-polymer particles to be chemically bonded to the outer gelatin layer of the silver halide particle. The cross linking agent used is preferably a gelatin hardener such as bisvinylsulfonylmethane ether, bisvinylsulfonylmethane, carbamoylonium compounds, dication ether compounds, carbodiimide compounds. Preferred cross linking agents are disclosed in above mentioned U.S. Pat. No. 5,026,632 to Bagchi et al (RA-6).

Generally the invention is accomplished by the use of gelatin-grafted-polymer particles that are preferably loaded or imbibed with photographically useful compounds, such as couplers. The photographically useful compounds can also be incorporated in the core polymer of the gelatin-grafted-polymer particles, by the use of a polymeric photographically useful compound as the core polymeric particle.

The chemical compositions of the core polymer particles have been described extensively in U.S. Pat. Nos. 4,920,004 to Bagchi (RA-3), 4,885,219 to O'Conner et al., 5,066,572 to Bagchi et al., 5,055,379 to Bagchi et al.(RA-4), and 5,026,632 to Bagchi et al. (RA-6), which are incorporated herein by reference. The core polymer particle of the gelatin-grafted-polymer particles utilized in this invention can be loaded with one or a combination of the following types of photographic agents by the method described in U.S. Pat. No. 4,199,363 to Chen (RA-8) or that of U.S. Pat. No. 5,091,296 to Bagchi et al. (RA-9):

a. Filter Dyes, b. Development Inhibitor Release Couplers, c. Development Inhibitor Anchimeric Release Couplers, d. Dye-Forming Couplers, e. Nucleators, f. Development accelerators, g. Ultraviolet Radiation Absorbing Compounds, h. Sensitizing Dyes, i. Development Inhibitors, j. Antifoggants, k. Bleach Accelerators, etc.

Attachment of photographic agents to silver halide-gelatin particle surfaces in many cases can improve the colloidal stability of the photographic emulsion as the thickness of the protective layer around the silver halide grain is now much greater than a layer of gelatin.

The chemical compositions of the core polymeric photographic agent particles, useful for this invention, have been described extensively in related art U.S. Pat. Nos. 4,855,219 to Bagchi et al. 5,066,572 to O'Conner et al., 5,055,379 to Bagchi et al. (RA-4), 4,877,720 to Sato et al. (RA-13), 4,464,462 to Sujimoto et al.(RA-14) and 4,080,211 to Van Paesschen (RA-15), which are incorporated herein by reference. Typical polymeric core photographic agent particles suitable for this invention are as follows:

a. Polymeric Filter Dye Particles, b. Polymeric Development Inhibitor Release Coupler Particles, c. Polymeric Development Inhibitor Anchimeric Release Coupler Particles, d. Polymeric Dye-Forming Coupler Particles, e. Polymeric Ultraviolet Radiation Absorbing Compound Particles, f. Polymeric Development Accelerator Particles, g. Polymeric Developer Particles, h. Polymeric Sensitizing Dye Particles, i. Polymeric Development Inhibitors, j. Polymeric Antifoggants, k. Polymeric Bleach Accelerators, etc.

Attachment of photographic agents to the preformed, pre-precipitated silver halide emulsion particles can improve the photographic performance of photographic products, in many cases.

It is known that the incorporation of gelatin-grafted-soft polymer particles in photographic layers with silver halide emulsions can vastly improve the pressure sensitivity of photographic film products, without hindering developability of the photographic film, for example, see U.S. Pat. Nos. 4,855,219 to Bagchi et al., 5,066,572 to O'Conner et al., 5,055,379 to Bagchi et al.(RA-4) and 5,026,632 to Bagchi et al. (RA-6) the disclosures of which are incorporated herein by reference. As described in these patents, the polymer core of the gelatin-grafted-soft polymer particles is a polymer that is soft and deformable, preferably with a glass transition temperature of less than 25 degrees C. and capable of being covalently bonded to gelatin, either directly of with the aid of a cross linking agent. Suitable materials are those polymer latex particles described in the above mentioned patents. A layer of soft gelatin-grafted-polymer particles attached to the gelatin layer surrounding pre-precipitated silver halide particles surface is believed to provide enhanced and improved pressure sensitivity of photographic elements, particularly those prepared from highly pressure sensitive thin tabular grain emulsions.

Figure 2:
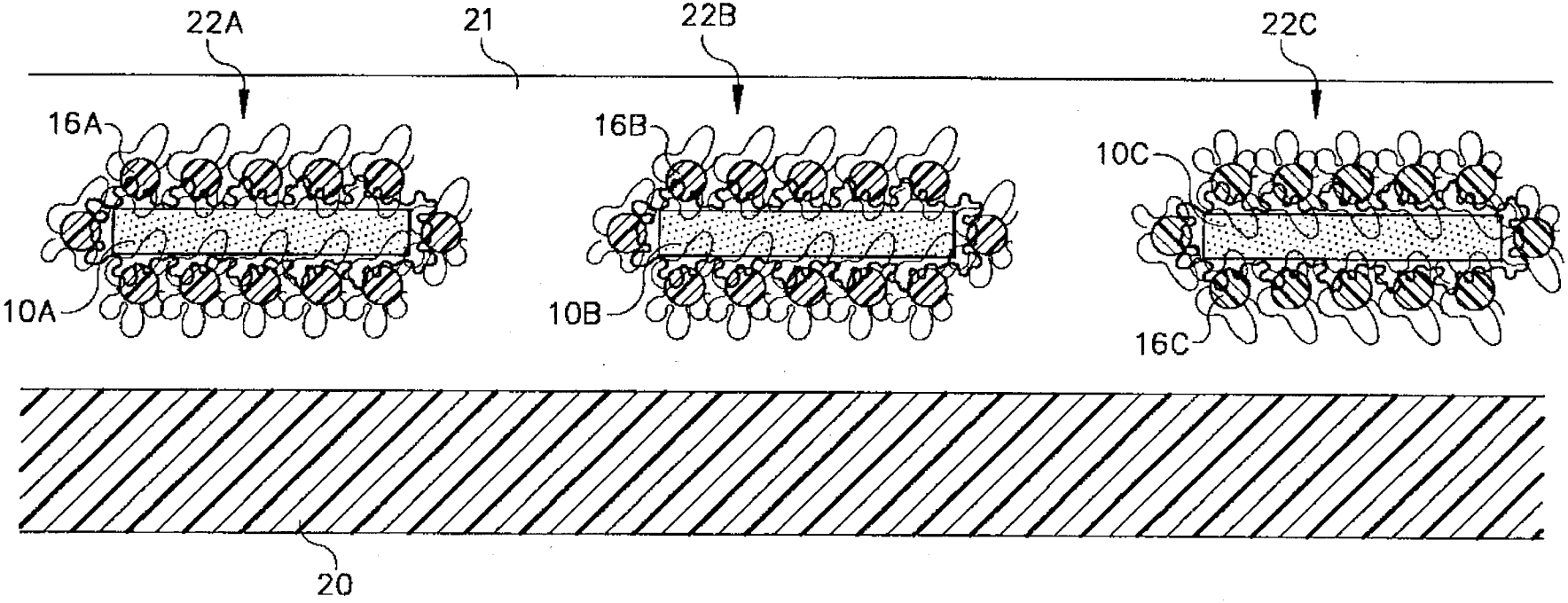
FIG. 2 is a conceptual depiction of a three color mixed-packet color photographic element achieved by the method of this invention.

In other embodiments, this invention provides a mixed-packet color photographic coating as pictorially indicated in FIG. 2. In FIG. 2, support 20 has on a surface thereof a layer 21 comprising composite particles 22*a*, 22*b* and 22*c*, each comprising gelatin-grafted-polymer particles 16*a*, 16*b* and 16*c* which contain cyan-, magenta- and yellow-dye forming couplers, respectively, attached to the gelatin layer of silver halide-gelatin particles 10*a*, 10*b* and 10*c* which have been sensitized to red, green and blue light respectively. Thus the mixed packet photographic element is composed of red, blue, and green sensitized silver halide emulsions mixed in a single layer with the red emulsion associated with attached cyan dye-forming coupler, the green emulsion associated with magenta dye-forming coupler, and the blue emulsion associated with yellow dye-forming coupler. A dispersion of oxidized developer scavenger may be interspersed among the packet emulsions to prevent color contamination between component particles.

The composite particles are separately prepared as discussed above for each color using (a) red sensitive silver halide grains having on the surface thereof adsorbed gelatin having an isoelectric pH of $P_{1a}$ and gelatin-grafted-polymer particles comprising a cyan dye forming coupler, in which particles the gelatin has an isoelectric pH of $P_{2a}$ which is different than $P_{1a}$; (b) green sensitive silver halide grains having on the surface thereof adsorbed gelatin having an isoelectric pH of $P_{1b}$ and gelatin-grafted-polymer particles comprising a magenta dye forming coupler in which particles the gelatin has an isoelectric pH of $P_{2b}$ which is different than $P_{1b}$; and blue sensitive silver halide grains having on the surface thereof adsorbed gelatin having an isoelectric pH of $P_{1c}$ and gelatin-grafted-polymer particles comprising a yellow dye forming coupler in which particles the gelatin has an isoelectric pH of $P_{2c}$ which is different than $P_{1c}$.

The silver halide packet emulsion prepared by the method of this invention, allows the attachment or adsorption of gelatin-grafted-polymeric dye-forming coupler particles or gelatin-grafted-dye-forming coupler loaded polymer particles to the silver halide-gelatin particles. Therefore, the dye-forming coupler by the method of this invention is intimately associated with the silver halide particles. Preparation of red sensitized silver halide packet emulsions using gelatin-grafted-cyan coupler particles, green sensitized silver halide packet emulsions using gelatin-grafted-magenta coupler particles, and blue sensitized silver halide packet emulsions using gelatin-grafted-yellow coupler particles and coating them in a single layer as shown in FIG. 2 can provide a high resolution mixed-packet color photographic system. The resolution would be high as the packet emulsion is formed by a single silver halide grain surrounded by the coupler(-containing) particles.

These preformed silver halide-gelatin emulsion particles having gelatin-grafted-polymers adhered to them may be utilized in conventional photographic materials as well as in the mixed-packet photographic elements.

In other embodiments of the invention the silver halide grains may be sensitized to infrared or ultraviolet light.

The support can be any suitable support used with photographic elements. Typical supports include polymeric films, paper (including polymer-coated paper), glass and the like. Details regarding supports and other layers of the photographic elements of this invention are contained in Research Disclosure, December 1978, Item 17643, referred to above. The support can be coated with a magnetic recording layer as discussed in Research Disclosure 34390 of November 1992, the disclosure of which is incorporated herein by reference.

As described above this invention provides photographic agents such as filter dyes, development inhibitor release couplers, development inhibitor anchimeric release couplers, dye-forming couplers, nucleators, ultraviolet radiation absorbing materials, development accelerators, developers, sensitizing dyes, and various photographic agents close to the silver halide grain surface by incorporating or loading such agents into polymer particles then grafting gelatin to the particles and attaching the resulting gelatin-grafted-polymer particles to silver halide-gelatin pre-precipitated particles. This results in the photographic agent being in close proximity with the silver halide grain surface.

EXAMPLES

The following examples are intended to be illustrative and not exhaustive of the invention. Parts and percentages are by weight unless otherwise mentioned. Coating laydowns are given in "mg/ft$^2$." Multiplication of these numbers by 10.7 will convert them to "mg/m$^2$." In some cases the "mg/m$^2$" numbers are also included within parentheses "( )."

Example 1

Preparation of Poly(Styrene-co-Butylacrylate-co-Ethylene Glycol

Dimethacrylate-co-Methacrylic Acid) Latex—Weight Ratio (37/37/2/24)

The latex was prepared by standard emulsion polymerization procedure (RA-11) as follows. A 5 L 3-neck round-bottom flask fitted with a condenser, an air stirrer and a supply for nitrogen under low blanketing pressure was charged with 4 L of nitrogen purged distilled water. The flask was placed in a constant temperature bath (CTB) at 60° C. After temperature equilibration 0.4 g of sodium dodecylsulfate surfactant was added to the reaction flask and a mixture of the following monomers:

| | |
|---|---|
| Styrene | 148 g |
| Butylacrylate | 148 g |
| Methacrylic Acid | 96 g |
| Ethylene Glycol Dimethacrylate | 8 g |
| TOTAL | 400 g |

Figure 3:
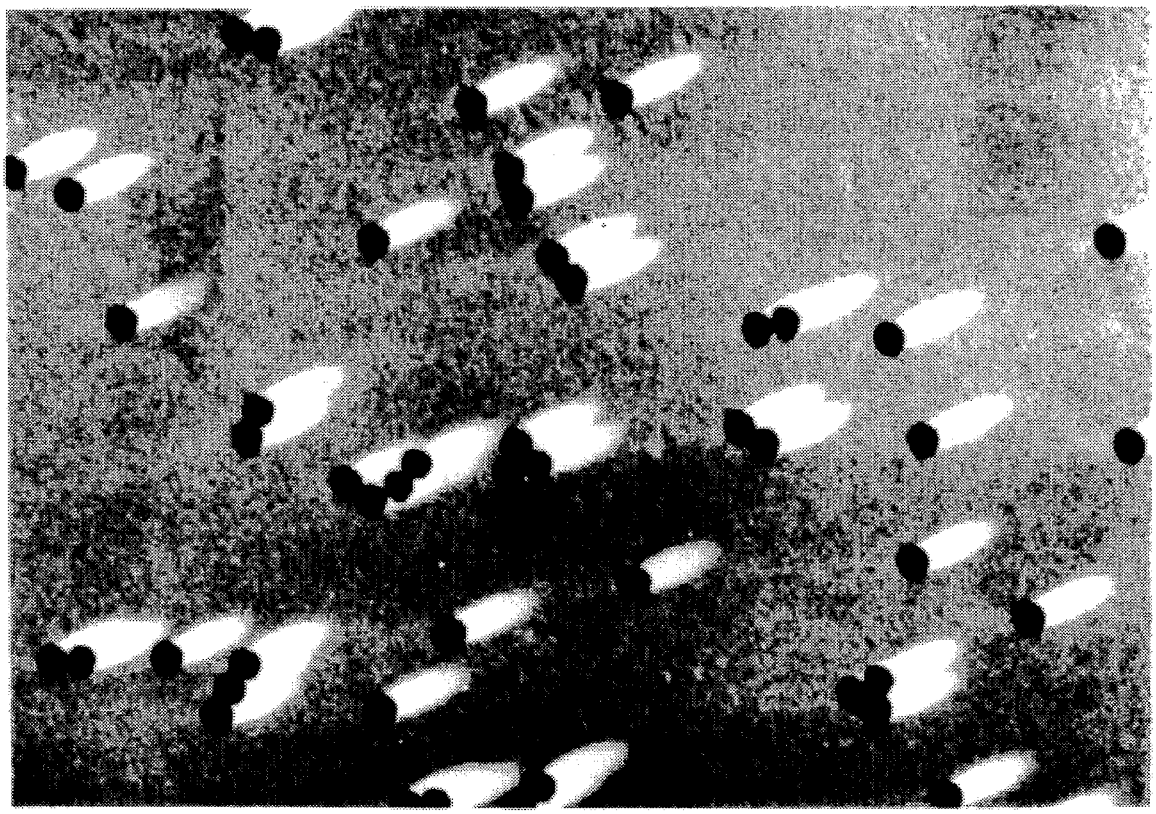
FIG. 3 is a shadowed electron photomicrograph of latex of Example-1.

To the formed emulsion was added 8 g of $(NH_4)_2S_2O_8$ and 4 g of $Na_2S_2O_5$. The polymerization reaction was carried out for 18 h at 60° C. The latex was dialyzed against distilled water for 24 h in a continuous dialysis set up. The dialyzed latex had a solids contrast of 8.4%. The particle size of the latex was measured by photon correlation spectroscopy to be 80 nm. FIG. 3 shows a representative shadowed electron photomicrograph of the latex particles. They appear to be indeed around 80 nm. This latex is designated as Latex (Example-I).

Example 2

Preparation of Gel-g-Latex (Example-I) [35% Gel-(A) ]

Gelatin-grafted-polymer particles described earlier (RA-3 and RA-4) were prepared with much larger excess of gelatin than that needed to saturate the surface of the particles. However, in order to use gelatin-grafted-polymer particles to attach to pre-precipitate emulsions, it is necessary to prepare gel-g-latex particles with no excess gelatin remaining in solution such that there is very little or no free gelatin to attach to the gel-silver halide particles. Therefore, all gelatin-grafting procedures in this work were carried out with less gelatin than that necessary to completely cover the surface.

Gelatin adsorption has been extensively studied by Curme et al. (RA-12) on Ag-halide surfaces. As expected for polypeptides that contain —COOH and —$NH_2$ groups, this adsorption excess is highly dependent on pH and ionic strength. An estimate for use in synthetic work is about 10 mg of gelatin adsorbed at saturation per sq meter of surface. The latex of Example 1 with a diameter of 80 nm has a surface area of 75 $m^2/g$. Therefore for 75% coverage of surface, we need about ($75\ m^2/g \times 0.75 \times 0.01\ g/m^2$)=0.56 g of gelatin per gram of the dry latex polymer. In other words, in the dry gel-g-latex polymer there will be [(0.56/1.56)×100] =35% gelatin. Gelatin used in this example is standard lime processed ossein gelatin designated as gelatin (A).

Based upon the above analysis, gelatin grafting to the latex of Example 1 was carried out as follows. 1190 g of the latex of Example 1 containing 100 g of dry polymer was adjusted to pH=8.0 using 20% NaOH solution and heated to 60° C. in 3-neck round-bottom flask. 52.9 g of deionized lime processed ossein gelatin (12.5% moisture) was dissolved in 500 g of water and heated to 60° C., and the pH was adjusted to 8.0 using 20% NaOH. 3.5 g of the gelatin grafting agent (I) (based upon 0.2 moles of (I) per mole of surface methacrylic acid, taken to be 5% of the polymer particle by weight) was added to the latex at 60° C. and stirred for 15 min. Then the gelatin solution at 60° C. was added to the latex dispersion and reacted for another 15 min. The gel-g-latex material was called gel-g-latex (Example I) [35% Gel-A] and had a solid constant of 9.0%. However, samples for all photographic testing were dialyzed at 40° C. continuously against distilled water to remove the fragments generated in the grafting reaction. See reaction scheme.

The chemistry of gelatin-grafting to carboxylated particles is generally assumed to proceed according to any of the following pathways.

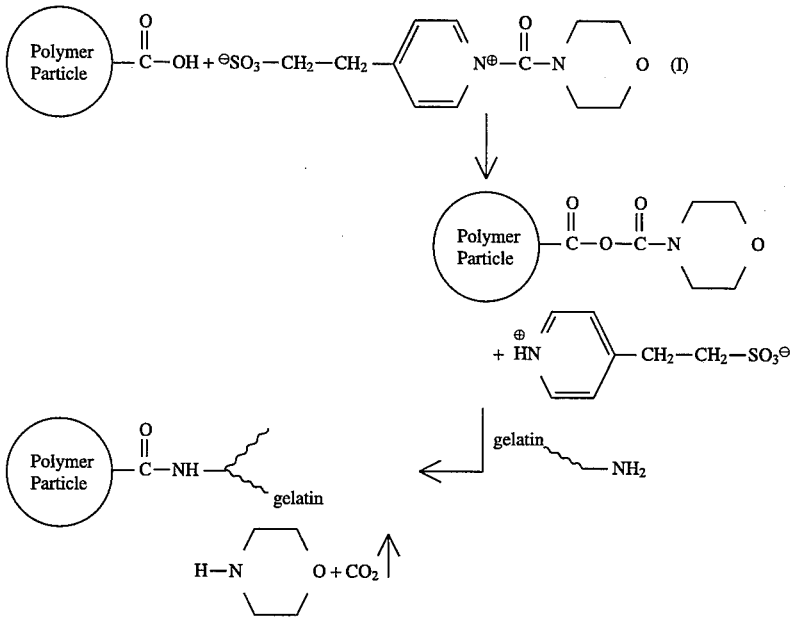

or,

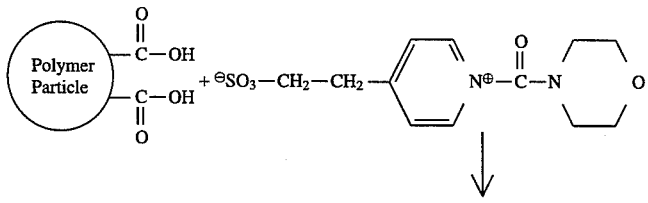

-continued

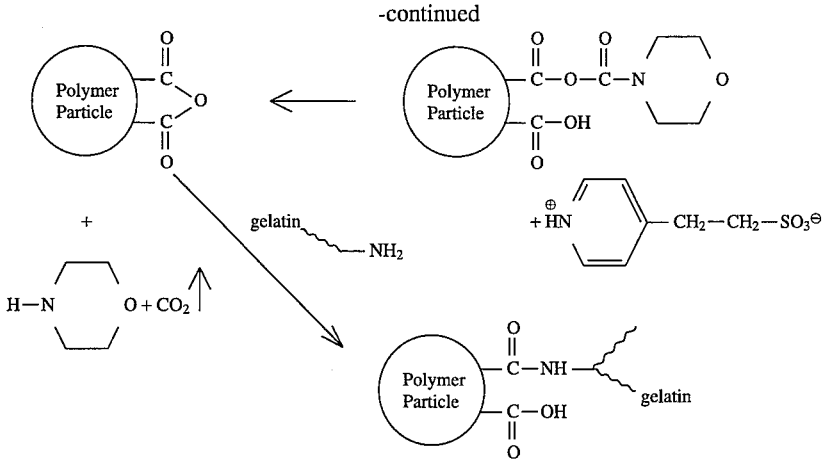

Example 3

Physical Characteristics of Gel-g-Latex of Example 2

Figure 4:
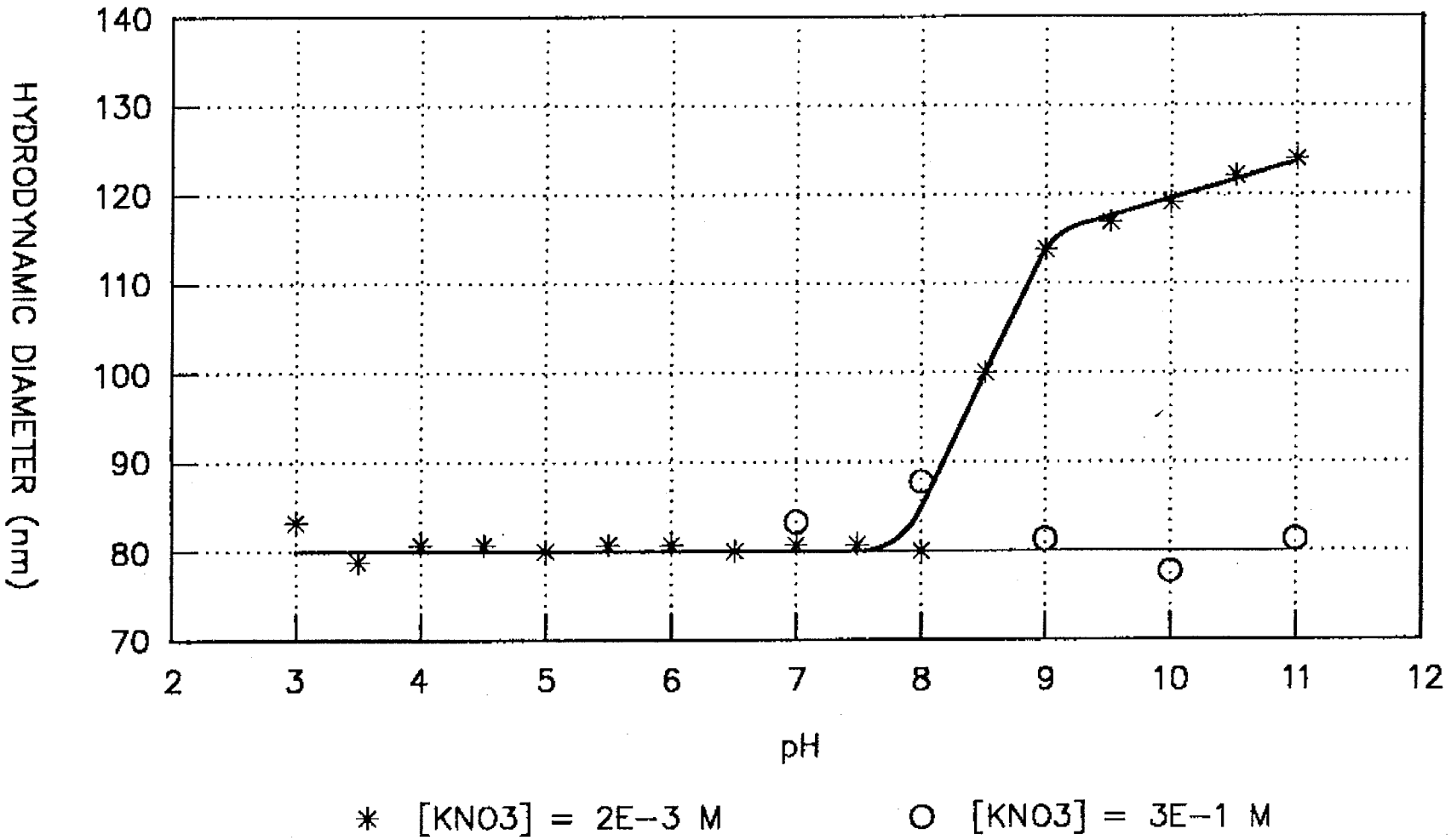
FIG. 4 illustrates the pH-dependence of the hydrodynamic size of the polymer latex of Example-1, as measured by photon correlation spectroscopy.

High carboxylic acid containing latexes are known to swell with increase in pH due to the ionization of the carboxylic acid groups (RA-12). FIG. 4 shows that in the case of latex of Example-1 swelling taking place around pH=8.0. This is greater than the pKa of carboxylic acid groups, as the van der Waals' attraction between the hydrophobic comonomers as butylacrylates and styrene resist swelling. The full charging of carboxyl groups must take place before the van der Waals' forces can be overcome. At pH 11 the 80 run particles are capable of swelling to about 120 nm, which corresponds to about 3.4 times the volume of the unswollen particles. It is seen, however, that at swamping ionic strengths (RA-3) (1M $KNO_3$) the swelling of the latex at high pH does not take place, indicating that the observed swelling is induced by the repulsion of the ionized latex particle.

Figure 5:
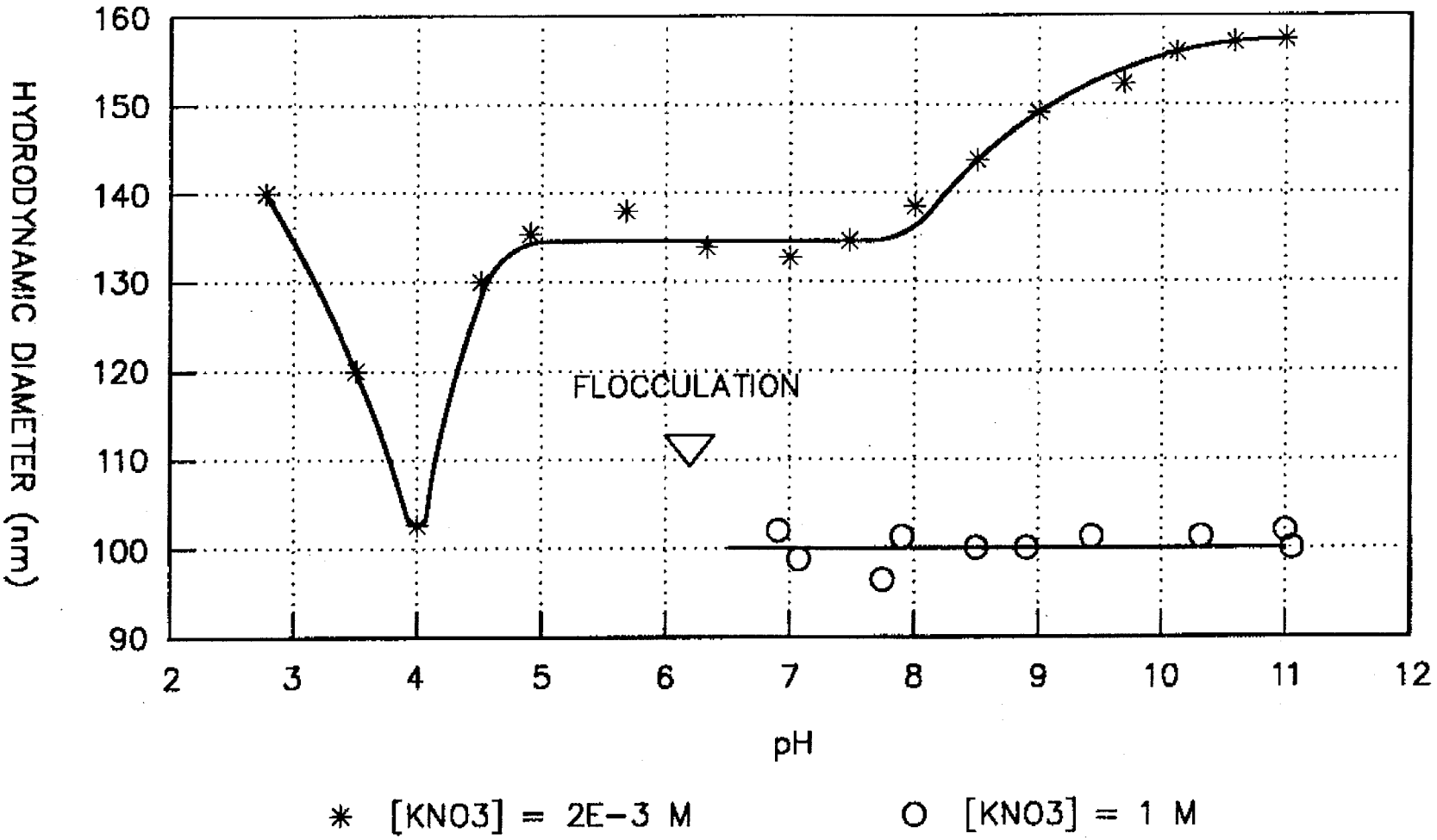
FIG. 5 illustrates the pH-dependence of the hydrodynamic size of the gelatin-grafted-polymer latex of Example-2, as measured by photon correlation spectroscopy.

FIG. 5 shows a similar plot of the pH dependence of the hydrodynamic diameter of gel-g-latex of Example-2 at low and swamping electrolyte concentrations. It has been shown earlier that gelatin adsorbed Ag halide particles show a pH dependence of the hydrodynamic size due to the ionization of the —COOH and —$NH_2$ groups of gelatin (RA-3). Below the isoelectric pH (IEP) of gelatin, the amine groups are charged leading to expansion of the adsorbed layer and above the IEP, the —COOH groups are ionized again leading to the expansion of the adsorbed layer of gelatin. The IEP is characterized by the smallest hydrodynamic size corresponding to its most compact size in the uncharged form (RA-13). In FIG. 5 is seen that the minimum of the hydrodynamic size occurred around pH=4.0 for gel-g-latex of Example-2, indicating that under low ionic strength conditions the IEP of gelatin around the gel-g latex particle is 4.8 (RA-6). However, ungrafted line processed ossein gelatin has an IEP of 4.8. This is because during grafting the —$NH_2$ groups are used for grafting to the particles, and hence a loss of net positive charge. As indicated earlier, this phenomenon is very useful for attachment and packet formation with gelatin-grafted-polymer particles.

It is interesting to note that the swelling of the inner core particle containing methacrylic acid above pH 8 can be observed over the gelatin swelling in FIG. 5. It is also seen in FIG. 5 that under swamping electrolyte conditions, the gel shell thickness is the same as that at the IEP. This also attests to the fact that observed particle expansion is due to ionization charging of the gel-g-latex particles. The gel-g-latex below pH=7 with 1M $KNO_3$ showed flocculation. This could be due to the shift of the IEP of gelatin to larger values at high ionic strengths, as observed by Cohen et al. (RA-24), in association with the desolvation of the bound gel shell at such high ionic strength. Table I shows a list of the isoelectric pH values of various gelatin and gel-g-latexes.

TABLE I

ISOELECTRIC PH VALUES OF VARIOUS GELATINS AND GEL-G-LATEXES

| Material | Isoelectric pH | Comments |
|---|---|---|
| Standard lime processed ossein gelatin (A) | 4.8 | (RA-24) |
| Gelatin (A) phthalated (B)* | 4.1 | (RA-24) |
| Gel (A)-g-latex | 4.0 | This work |
| Phthalated gel (B)-g-latex | ~3.3 | Estimate |

*Phthalated gelatin (B) was obtained by phthalation of 100 g of gelatin (A) with 5.0 g of phthalic anhydride as described in (RA-24).

Example 4

Preparation of Poly(styrene-co-butylacrylate-co-methacrylic acid) Latex—Weight Ratio (37/37/24)

Preparation of the latex of Example-4 was carried out according to procedures described earlier in Example-1, except the amounts of monomers, initiators, and surfactant used were as follows:

| | |
|---|---|
| Styrene | 152.0 g |
| Butylacrylate | 152.0 g |
| Methacrylic Acid | 96.0 g |
| $K_2S_2O_8$ | 2.0 g |
| $K_2S_2O_5$ | 1.0 g |
| Sodium dodecyl sulfate | 0.4 g |

Reaction was carried out at 60° C. for 20 hrs. The resultant latex had a solid content of 8.3% and a PCS particle diameter of 95 nm. The calculated specific surface area of the latex was 63 $m^2/g$.

Example 5

Preparation of Gel-g-Latex (Example 4) [30% Phthalated Gelatin (B)]

Gel-g-latex of Example-4 (30% phthalated gelatin (B)] was prepared much the same manner as before (Example-3). 4.11 kg of the latex (=341 g of polymer) of Example-4 was heated to 60° C. and adjusted to a pH of 8.0. 11.9 g of grafting agent (I) (0.2 mole per mole of surface methacrylic acid, assumed 5% as before) was added to the latex as a 10% aqueous solution and allowed to react at 60° C. for 15 min. 145 g of phthalated gelatin B was dissolved in 1640 g of distilled water at 60° C. and pH of 8.0. After 15 min of reaction of the latex with compound (I), the gel solution was added to the latex and reacted for another 15 min at 60° C. The amount of gelatin used was designed to cover about 75% of the latex surface with no gelatin left in solution as discussed before. The resultant gel-g-latex had a solids content of 8.4%. The physical characteristics of the latexes and gel-g-latexes of this invention are given in Table II.

TABLE II

CHARACTERISTICS OF THE LATEX AND GEL-G-LATEX PARTICLES

| Latex | Unswollen Particle Dia. of Latex in nm by PCS | Surface Area of Latex in $m^2/g$ | Solids of Latex in % | Gel-g-Latex | % of Latex Surface Covered by Grated Gelatin | Solids of Gel-g-Latex in % |
|---|---|---|---|---|---|---|
| of Example 1 | 80 | 75 | 8.4 | of Example 2 | 75 | 9.0 |
| of Example 4 | 95 | 63 | 8.3 | of Example 5 | 75 | 8.4 |

Example 6

Preparation of Cubic AgCl Emulsion

| | | |
|---|---|---|
| Make Kettle: | Rousselot lime processed ossein | 10.8 g |
| | Nalco antifoam | 0.7 ml |
| | Distilled water | 2989.2 g |
| | Temperature | 60° C. |
| | pH | 5.05 |
| | Control set point | pAg = 7.55 |
| Silver Solution: | $AgNO_3$ | 0.1M |
| Salt Solution: | NaCl | 0.4M |

Figure 6A:
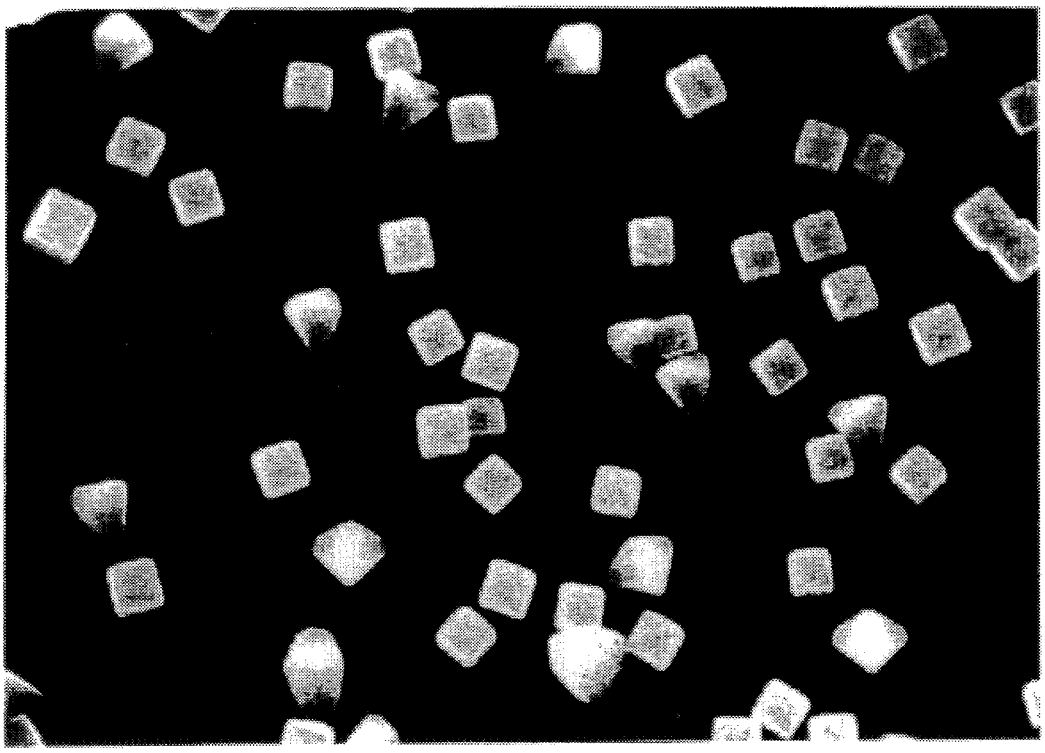
FIG. 6*a* is a scanning electron photomicrograph of emulsion of Example-6, precipitated with lime processed ossein gelatin

It is to be especially noted that this is a very low gel emulsion. Just enough gel was added to keep the emulsion peptized with virtually no gel left in solution. The kettle contents were melted at 45° C. with stirring and then adjusted to pH=5.05 at 40° C. The kettle temperature and pAg (=–log[$Ag^+$]) was set to control point of 7.55 with 5M NaCl. Stirring rate was increased from 2500 to 4000 rpm. Solutions of 0.4M NaCl and 0.1M $AgNO_3$ were added by a double-jet precipitation method (RA-23) with an accelerated flow profile from 22 ml/min to 115 ml/min in 13.25 min. The flow rate was held constant at 115 ml/min for the remainder of the make, while maintaining the pAg at 7.55 by means of a Honeywell controller. The total run time was 39.9 min. After precipitation of the emulsion, the pH of the emulsion was lowered to 3.80 with 4.0M $HNO_3$. The emulsion was allowed to settle. An electron photomicrograph of the emulsion crystals are shown in FIG. 6*a*. In such a low gel preparation it is noted that some grain shapes are a bit irregular from cubes. EGA (electrolytic grain size analysis) indicated a number average cubic grain edge length of 480 nm.

Example 7

Preparation of Tabular Grain AgBr(I 3%) Emulsion

| | | |
|---|---|---|
| Make Kettle: | Oxidized lime processed ossein deionized gelatin | 10.5 g |
| | Nalco antifoam | 0.7 ml |

-continued

| | | |
|---|---|---|
| | Deionized water | 3961 g |
| | pH adjusted to | 1.85 |
| | Initial temperature | 35° C. |
| | Growth temperature | 60° C. |
| | Initial set point | pAg = 9.63 |
| | Control set point | pAg = 8.94 |
| Silver Solution: | $AgNO_3$ | 1.0M |
| Salt Solution: | NaBr | 1.0M |

-continued

| | | |
|---|---|---|
| Auxiliary Salt Solution (Tandem with Ag) | KI | 0.03M |

Figure 7A:
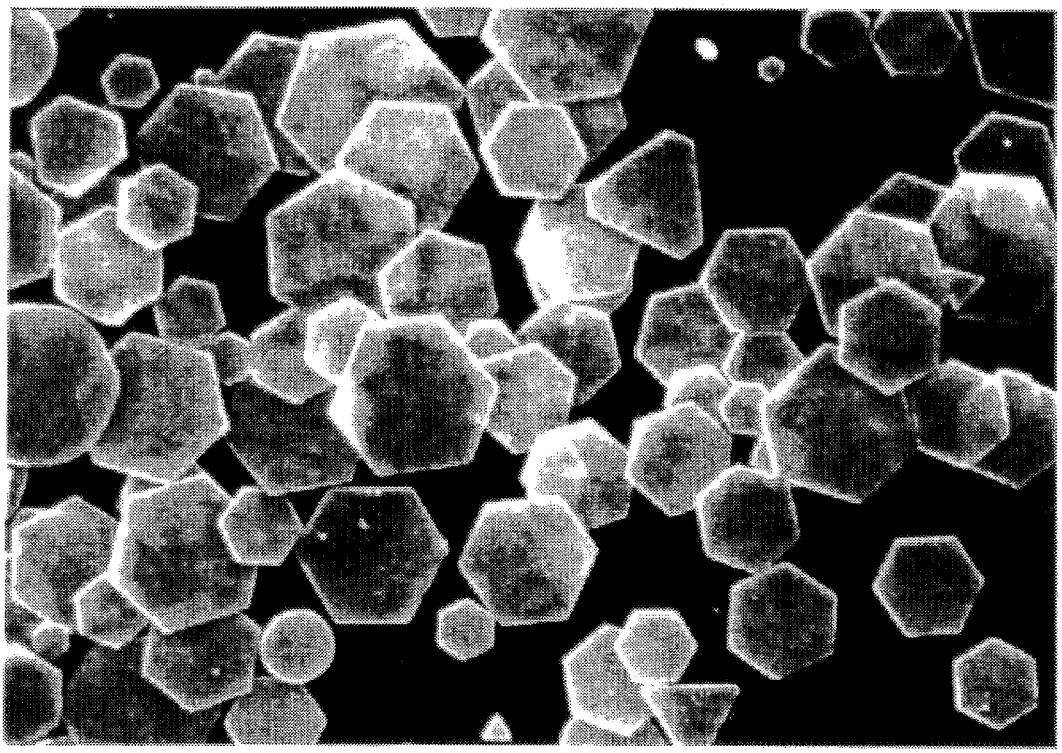
FIG. 7*a* is a scanning electron photomicrograph of tabular grain emulsion of Example-7 precipitated with lime processed ossein gelatin and FIG. 7*b* is a scanning photomicrograph of tabular grain emulsion of Example-9, where gelatin-grafted-polymer latex particles [30% phthalated gelatin] of Example-5, were attached to the surface of the AgBr(I 3%) gelatin surrounded grains of the emulsion of Example-7.

The preparation was a triple jet make with an auxiliary salt solution of KI, whose flow was maintained in tandem with the silver flow. The Ag and the salt solutions were added to the kettle at rates of 53 and 56 ml/min, respectively, without controlling the pAg, in order to form nuclei under a twinning environment. Following nucleation for 30 sec, the pumps were stopped and the temperature was ramped to 60° C. over a period of 15 min. The nuclei were held at 60° C. for 3 min and then 1 liter of a solution containing 133.4 g of oxidized gelatin and 5.49 g of NaBr was dumped into the kettle. The pAg after the dump was 8.94. The pH was adjusted to 6.00 and then the Ag and the salt solutions were added to the kettle while controlling both the temperature and the pAg at the set points for a period of 63.5 min. The initial flow rate was 10 ml/min, ramped to 117 ml/min. The temperature was brought down to 40° C. after the make, and it was washed as described in Example-3 of reference (RA-29). The final gelatin concentration was made up to 40 g per mole of silver halide. 1.0 g of 4-chloro-3,5-xylenol was added as a preservative. Image analysis of this emulsion gave an equivalent circular grain diameter of 1200 nm and coated reflection measurement provided an average grain thickness of 45 nm. FIG. 7*a* shows an SEM picture of the grains of this emulsion.

Example 8

Attachment of Gel-g-Latex [35% Gel] of Example 2 Onto the Surface of Gel Precipitated Cubic AgCl Emulsion Grains of Example 6

Figure 6B:
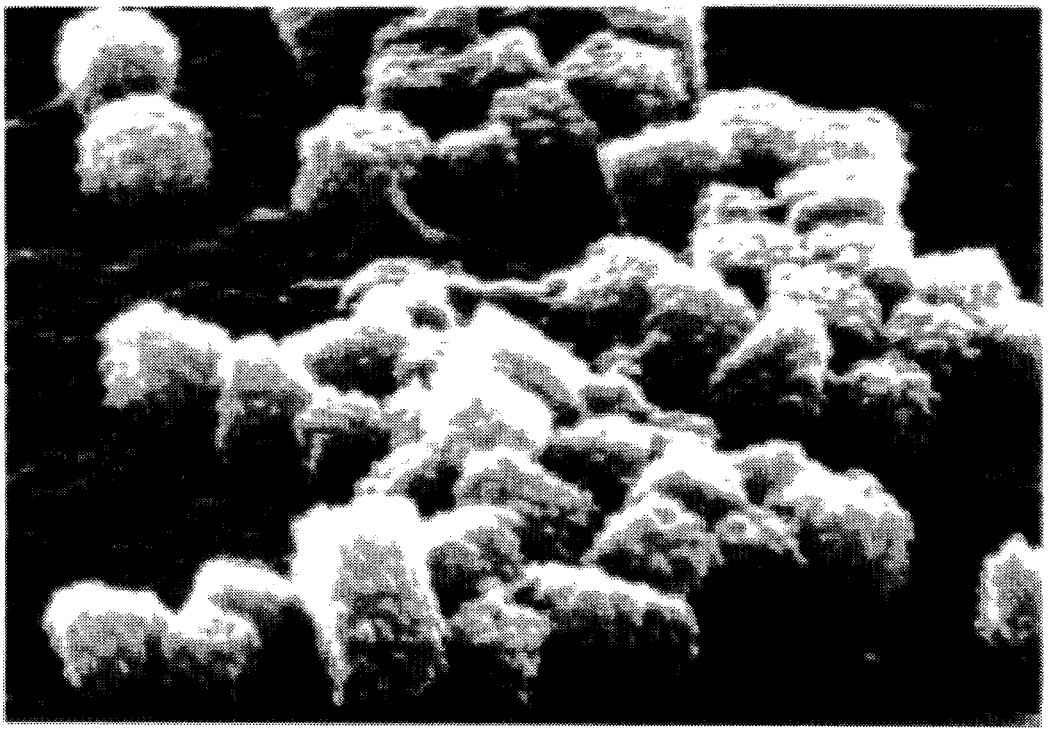
FIG. 6*b* is a scanning electron photomicrograph of Example-8, where gelatin-grafted-polymer latex [35% Gel] of Example-2 are attached to the AgCl grains of the emulsion of Example-6. Please note that the magnification of FIG. 6*a* is half that of FIG. 6*b*.

50 g of emulsion of Example-6 (0.036 mole/L) was allowed to stand at 40° C. The supernatant was decanted off and replaced with an equal volume of deionized water. This mixture was then heated to 40° C. and 5 g of gel-g-latex [35% gel] of Example-2 was added to the emulsion. The pH was lowered to 3.6 and the mixture was allowed to stand. The supernatant was decanted and replaced with deionized water. This procedure was repeated twice more. The last time the emulsion was left in the concentrated form. The material was coated on a scanning electron microscope (SEM) stage, evaporation coated with gold/palladium for enhanced contrast. The SEM picture is shown in FIG. 6*b*. It is clearly seen that the gel-g-latex particles are attached to the surface of the AgCl crystals, with very few unattached gel-g-latex particles in the field. Even though this emulsion sample was not coated, it is expected that such emulsion grains would be photographically active, as the emulsion grains were prepared by normal and known gelatin precipitation procedures.

Example 9

Attachment of Gel-g-Latex [30% Gel] of Example 5 Onto the Surface of Gel Precipitated Tabular AgBr(I 3%) Emulsion Grains of Example 7

0.05 g of sensitizing dye (compound II)

Figure 7B:
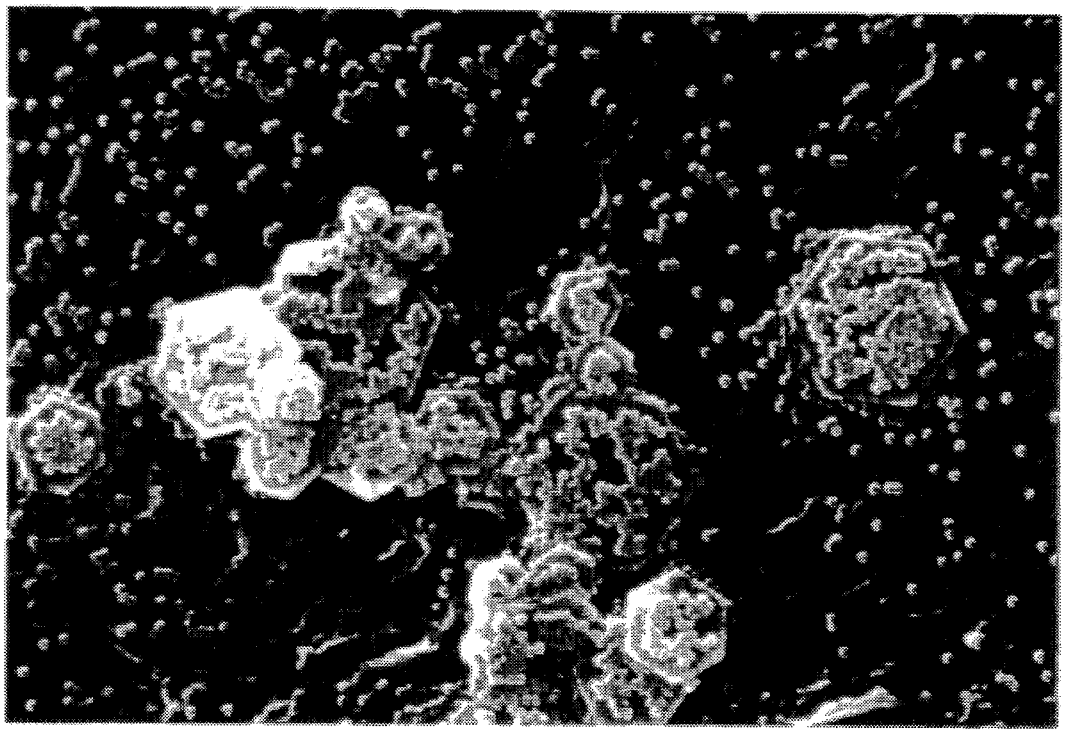
Figure 8:
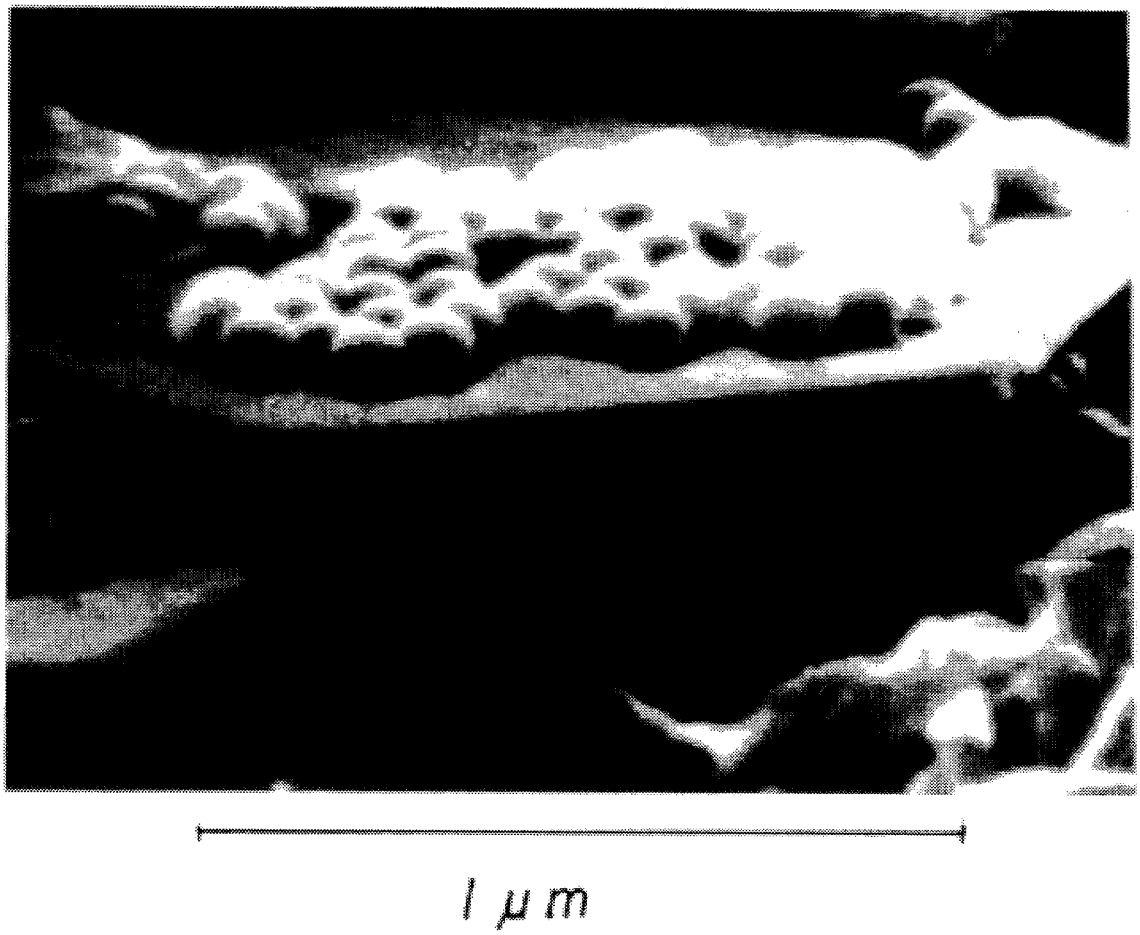
FIG. 8 is an enlarged view of an emulsion grain of Example-9.

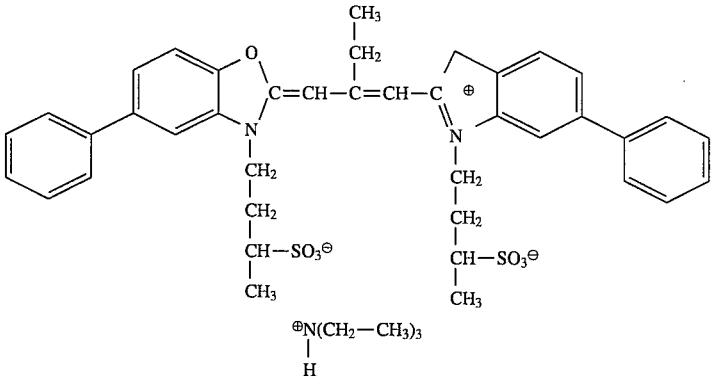

was dissolved in 25 ml of methanol and was added to 0.05 moles of emulsion of Example-7 at 40° C. This mixture was heated from 40° C. to 60° C. in 12 min, held for 15 min at 60° C. and then chilled down to 40° C. 60 g of gel-g-latex of Example-5 was added at 40° C., followed by the dropwise addition of 3.3 ml of an 1.8% of bis(vinylsulfonylmethane) to the emulsion with stirring. It was held at 40° C. with stirring for 6 hrs. The emulsion was then chill set and stored at 4° C. FIG. 7*b* shows SEM pictures of the emulsion grains after gold/palladium coating. It shows definite attachment of the gel-g-latexes to the Ag halide grains. Since the emulsion was not isowashed, the unattached grains were not removed and are also seen along with the gel-g-latex attached emulsion grains. The experiments show the use of a gelatin hardener to attach the gel-g-latex particles to the preformed Ag halide grain surface, rather than by charge interaction by lowering of pH. FIG. 8 shows an enlarged view of the gel-g-latex attached emulsion grains of FIG. 7*b*. These grains were not coated and tested for photographic sensitivity, as such gelatin precipitated conventional grains are well known to be photographically active, and the material of this example is expected to be photographically active.

This invention has been described in detail with particular reference to preferred embodiments thereof, but it will be understood that variations and modifications can be effected within the spirit and scope of the invention.

What is claimed is:

1. A method of preparing a photographic silver halide emulsion composition comprising:

(i) mixing in an aqueous medium (a) silver halide-gelatin particles comprising silver halide grains, each surrounded by a layer of adsorbed peptizing gelatin in which the peptizing gelatin has an isoelectric pH of $P_1$; and (b) gelatin-grafted-polymer particles in which the grafted gelatin has an isoelectric pH of $P_2$ which is different than $P_1$; and (ii) adjusting the pH of the aqueous medium to a value that is between $P_1$ and $P_2$, whereby gelatin-grafted-polymer particles are attached to the silver halide gelatin particles.

2. The method of claim 1 wherein said silver halide grains have a cubic, octahedral, or tabular crystal structure.

3. The method of claim 1 wherein said silver halide grains comprise silver chloride, silver iodobromide, or silver chlorobromide.

4. The method of claim 1 wherein said silver halide grains further comprise a dye that spectrally sensitizes said grains to wavelengths of light of at least one of the following visible light ranges:

blue, green, red, infrared, and ultraviolet.

5. The method of claim 1 wherein said silver halide grains have a single dimension ranging between about 10 nm and 10,000 nm.

6. The method of claim 1 wherein said gelatin grafted polymer particles comprise at least one photographic agent selected from at least one member of the group consisting of:

filter dyes, development inhibitor release couplers, development inhibitor anchimeric release couplers, dye-forming couplers, nucleators, accelerators for photographic development, ultraviolet radiation absorbing compounds, sensitizing dyes, development inhibitors, antifoggants, and bleach accelerators.

7. The method of claim 1 wherein said gelatin-grafted polymer particles comprise grafted gelatin and a polymer selected from at least one member of the group consisting of:

polymeric filter dye, polymeric development inhibitor release coupler, polymeric development inhibitor anchimeric release coupler, polymeric dye-forming coupler, polymeric ultraviolet radiation absorbing compound, polymeric development accelerator, polymeric developer, polymeric sensitizing dye, polymeric development inhibitors, polymeric antifoggants, and polymeric bleach accelerators.

8. The method of claim 1 wherein the peptizing gelatin of the silver halide-gelatin particles and the grafted gelatin of the gelatin-grafted-polymer particles are different and are each selected from the group consisting of:

acid processed ossein gelatin, lime processed ossein gelatin, phthalated gelatin, acetylated gelatin, and succinated gelatin.

9. The method of claim 1 wherein the gelatin-grafted-polymer particles are chemically bonded to the silver halide-gelatin particles using a gelatin hardener selected from any of the following or a mixture thereof:

bisvinylsulfonylmethane ether, bisvinylsulfonylmethane, carbamoylonium compounds, dication ether compounds, and carbodiimide compounds.

10. The method of claim 1 wherein the difference between $P_1$ and $P_2$ is at least about one unit of pH value.

11. The method of claim 1 wherein the difference between $P_1$ and $P_2$ is at least about 1.5 units of pH value.

12. The method of claim 1 wherein the difference between $P_1$ and $P_2$ is at least about 2.0 units of pH value.

* * * * *